US007140838B2

(12) United States Patent
Raulin et al.

(10) Patent No.: US 7,140,838 B2
(45) Date of Patent: Nov. 28, 2006

(54) CONTROL LEVER ATTACHMENT WITH PLAY COMPENSATION FOR BLADES WITH VARIABLE SETTING ANGLES

(75) Inventors: Dominique Raulin, Avon (FR); Alain Chatel, Vaux le Penil (FR)

(73) Assignee: Snecma Moteurs, Paris (FR)

( * ) Notice: Subject to any disclaimer, the term of this patent is extended or adjusted under 35 U.S.C. 154(b) by 0 days.

(21) Appl. No.: 10/837,595

(22) Filed: May 4, 2004

(65) Prior Publication Data

US 2004/0265119 A1 Dec. 30, 2004

(30) Foreign Application Priority Data

May 7, 2003 (FR) ..... 03 50148

(51) Int. Cl.
*F01D 17/16* (2006.01)

(52) U.S. Cl. ..... 415/159; 415/160

(58) Field of Classification Search ..... 415/148, 415/156, 159, 160, 162
See application file for complete search history.

(56) References Cited

U.S. PATENT DOCUMENTS 4,668,165 A 5/1987 Ludwick
4,767,264 A 8/1988 Kisling et al.
5,024,580 A 6/1991 Olive
2002/0034439 A1 3/2002 Caubet et al.
2003/0147743 A1* 8/2003 Chatel et al. ..... 415/160

FOREIGN PATENT DOCUMENTS

FR 2 814 206 3/2002

* cited by examiner

*Primary Examiner*—Richard A. Edgar
(74) *Attorney, Agent, or Firm*—Oblon, Spivak, McClelland, Maier & Neustadt, P.C.

(57) ABSTRACT

The manufacturing cost of the control device is relatively low.

This device comprises mainly a first end (46) of a control lever (40) provided with a drive hole (45) that drives the driving part (16) of a blade (10) through a first contact area (41). The close contact between these two parts in this area is obtained using a play compensation plate (50) bearing on a side part (47) of the control lever (40), and fixed to the assembly using a nut (60) screwed onto the external pivot (11) of the blade (10).

For application on turbomachines.

17 Claims, 3 Drawing Sheets

CONTROL LEVER ATTACHMENT WITH PLAY COMPENSATION FOR BLADES WITH VARIABLE SETTING ANGLES

DOMAIN OF THE INVENTION

The invention relates to the control of blades with a variable setting angle in turbomachines. It is particularly applicable to turbomachines for use in aeronautics, particularly for the control of air inlet guide vanes in turbomachine compressors, such as aircraft turbojets.

PRIOR ART AND PROBLEM THAT ARISES

Known devices for controlling blades with variable setting angles in a turbomachine, particularly at compressor inlets, normally comprise a control device in the form of a ring surrounding a casing of the turbomachine and several levers or control rods. Each lever has a first end fitted on a pivot of a blade with its axis coincident with the pivot axis of the blade, and a second end connected through an articulation to the control ring. Therefore, the angular position of the blades is modified synchronously by rotating the ring about the axis of the turbomachine. The connection between each lever and the ring comprises at least one degree of freedom in rotation about an axis approximately in the radial direction with respect to the ring, so as to be able to follow the rotation movement of the control ring. However, since the lever is installed rigidly on the pivot of the corresponding blade, the rotation of the ring induces other relative movements between the ring and the part of the lever installed on the pivot of the blade.

The rotation movement applied to the blades is essential to optimize the efficiency of the turbomachine and the margin against "pumping". The precision and hysteresis are very important for modern high-pressure bodies. In other words, the attachment of the end of the control lever onto the pivot of the blade must be very precise.

FIG. 1 illustrates such a mechanism. A compressor casing and a bushing 2 are shown in the figure, and the external pivot 11 of a blade 10 is installed in the bushing and is free to turn. An inner pivot 62 of this blade 10 is installed free to turn in a bushing 4 of the inner ring 3. The control lever 20 is provided with a first part 21 fixed rigidly to the outer pivot 11 of the blade 10 using a nut 63. A second end 22 of the control lever 20 is provided with a control pivot 23 installed free to turn in a hole of the control ring 30.

To achieve this, and with reference to FIG. 2, the first part 21 of the control lever 20 is provided with a square hole 24. Conversely, the outer pivot 11 of the blade 10 is provided with a square bit drive 64. The fit of the square bit drive into the drive hole 24 of the control lever 20 must be very precise. Therefore, this requires difficult and expensive machining, in the same way as all square drives.

The purpose of the invention is to overcome this disadvantage by proposing another system for attachment of the control lever on the external pivot of the blade.

SUMMARY OF THE INVENTION

In this respect, the main purpose of the invention is a control device for blades with variable setting angles in a turbomachine comprising a control ring and several control levers each with a first end in which there is a drive hole and on which a drive part of an external pivot of a corresponding blade is mounted, and a second end connected to the control ring through an articulation, such that rotation of the control ring about the axis of the turbomachine causes a change in the blade setting angle.

According to the invention, the control lever is made of sheet metal, its drive hole has a first drive part that comes into contact with the drive part of the external pivot defining a first contact area between the control lever and the external pivot, with a play remaining between the drive part of the external pivot of the blade and the drive hole of the control lever in a direction perpendicular to the contact area, the rotational drive of the first end of the control lever on the drive part of the blade being made through a play compensation plate that bears on a side part of the control lever approximately perpendicular to the first end of the control lever, through a second contact area between the control lever and the play compensation plate, approximately parallel to the first contact area to force the drive part of the blade onto the first end of the control lever through the first contact area.

According to one preferred embodiment of the invention, the side part of the control lever on which the second contact area between the control lever and the play compensation plate is located, is perpendicular to the plane of the play compensation plate forming the control lever, the play compensation plate also being provided with a curved part that bears on the side part of the control lever through a second contact area between the control lever and the play compensation plate.

Preferably, the play compensation plate is provided with a hole similar to the drive hole used in the control lever, and for which one side comes into contact with a wall of a recess in the blade located at the bottom of the external pivot, to form a third contact area between the play compensation plate and the external pivot.

Preferably, the first contact area between the control lever and the drive part is plane in shape.

LIST OF FIGURES

The invention and its various technical characteristics will be better understood after reading the description given below, accompanied by several figures in which.

DETAILED DESCRIPTION OF AN EMBODIMENT OF THE INVENTION

Figure 1:
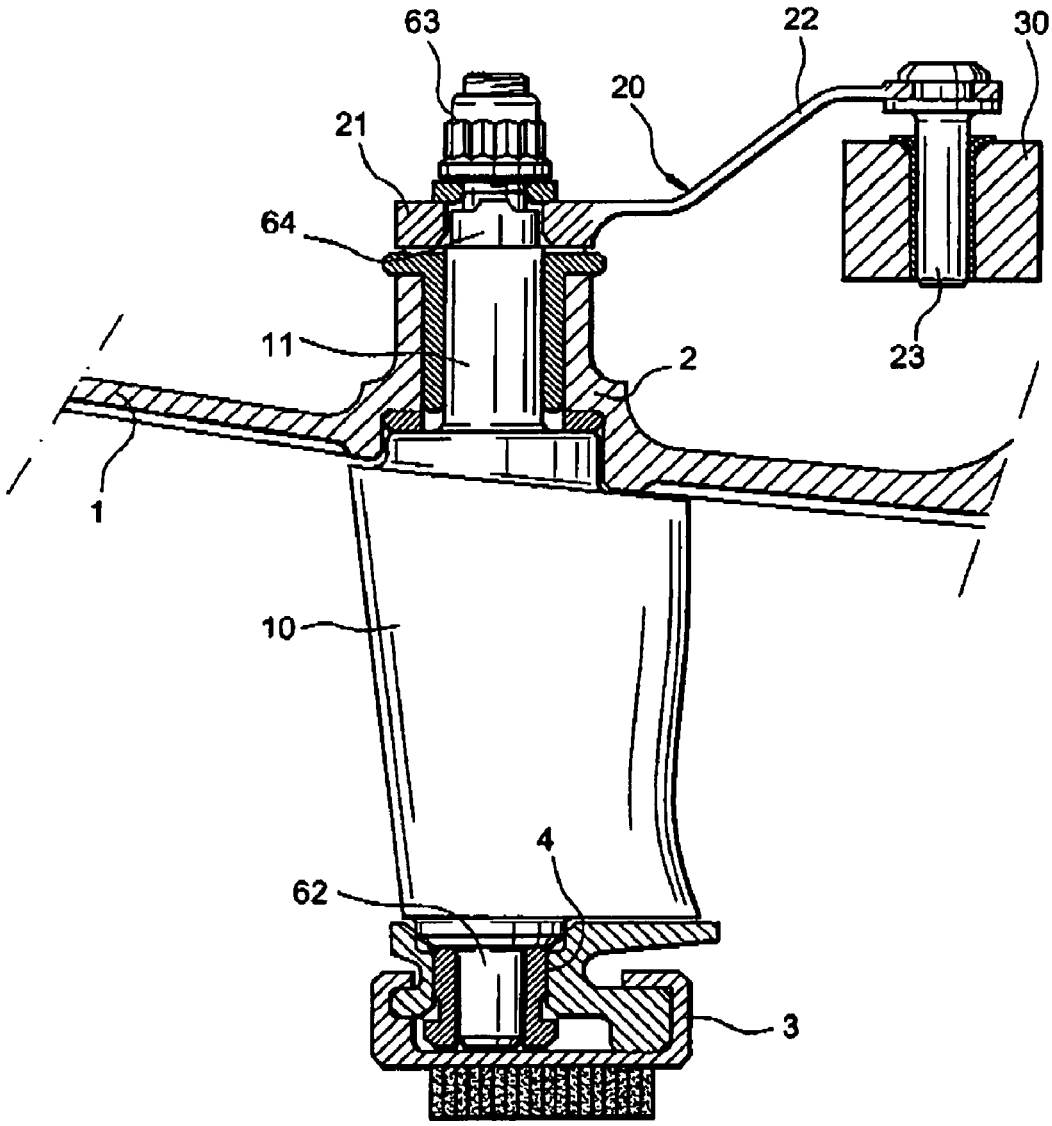
FIG. 1 shows the location of the device according to the invention in a first turbomachine compressor stage.
Figure 2:
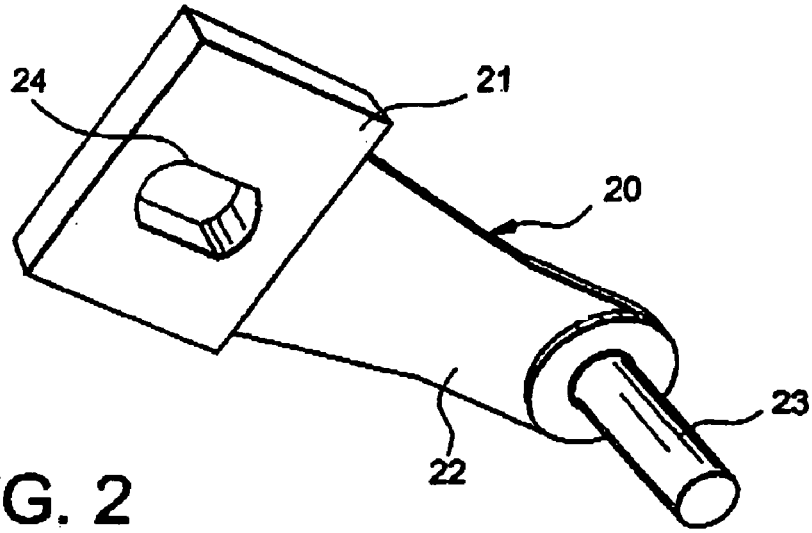
FIG. 2 PRIOR ART
FIG. 2 shows an isometric view of the transmission lever according to prior art.
Figure 3:
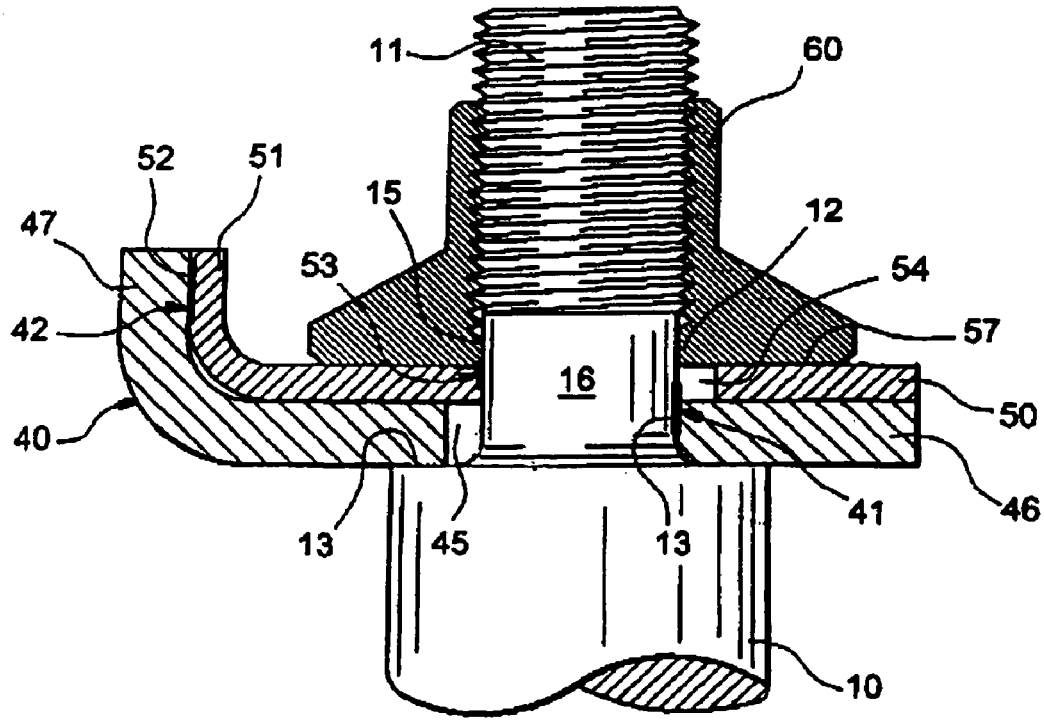
FIG. 3 shows a sectional view of the device according to the invention.

All the main innovative elements are shown in section in FIG. 3.

Firstly, a distinction is made between a blade 10 and more precisely its external end, in other words an external pivot 11 connected to the blade 10 through a drive part 16. This drive part is characterized by a narrowing or recess 12 relative to the diameter of the external pivot 11. The second essential part of the device is the control lever 40, and what can be seen most clearly is its first end 46. This first end is provided with a drive hole 45 that is slightly wider than the section of the drive part 16 of the blade 10 and the external pivot 11, but not as wide as the main part of the blade 10, such that the control lever 40 can bear on the blade 10.

The rotation drive of the blade 10 through the control lever 40 is made by a first contact area 41 on a contact part 13 of the drive part 16 of the blade 10, in contact with the internal wall of the drive hole 45 of the control lever 40. This first contact area 41 is located in the first end 46 of the control lever 40, on the side opposite the side part 47 and curved by about 90° compared with the first end 46. The purpose of the principle according to the invention is to provide firm contact between the contact part 13 of the drive part 16 of the blade 10 with the first end 46 of the control lever 40, at the first contact area 41.

Consequently, a play compensation plate 50 with a hole 54 with a width equivalent to the width of the drive hole 45 of the control lever 40 is used, so that it can slide onto the external pivot 11. This play compensation plate 50 has a curved part 51 making an angle of about 90° with a clamping surface 57 of the play compensation plate 50 and that will come into bearing contact on the inside of the side part 47 of the control lever 40 through a second contact area 42.

The hole 54 on the side of the curved part 51 comes into contact with a wall 15 of the recess 12 at the bottom of the external pivot 11, through a third contact area 53 between the play compensation plate 50 and the external pivot 11, because the distance separating this third contact area 53 from the second contact area 52 is equal to the distance separating the first contact area 41 from the second contact area 42 of the control lever 40 minus the section of the drive part 16 of the blade 10 at the recess 12. Consequently, when the play compensation plate 50 is put into place inside the hollow formed by the first end 46 and the side part 47 of the control lever 40, surrounding the recess 12, the play compensation plate 50 bearing in contact with the side part 47 on a second contact area, forces the control lever 40 into contact with the contact part 13 of the recess 12 through the first contact area between the external pivot 11 and the control lever 40, on a third contact area 53 between the play compensation plate 50 and the external pivot 11 of the blade.

Thus, it can easily be understood that a precise and well defined contact on the first contact area 41 is obtained by the curved part 51 of the play compensation plate 50 bearing on the second, contact area 42, the control lever 40/play compensation plate 50 forcing the recess 12 of the blade 10 into contact with the first end 46 of the control lever 40 through the contact between the play compensation plate 50 and the external pivot 11.

The play compensation plate 50 is put into position and held in position by means of a nut 60 that screws onto the pivot 11 of the blade 10 and thus bears in contact with the inner surface 57 of the play compensation plate 50.

Figure 4:
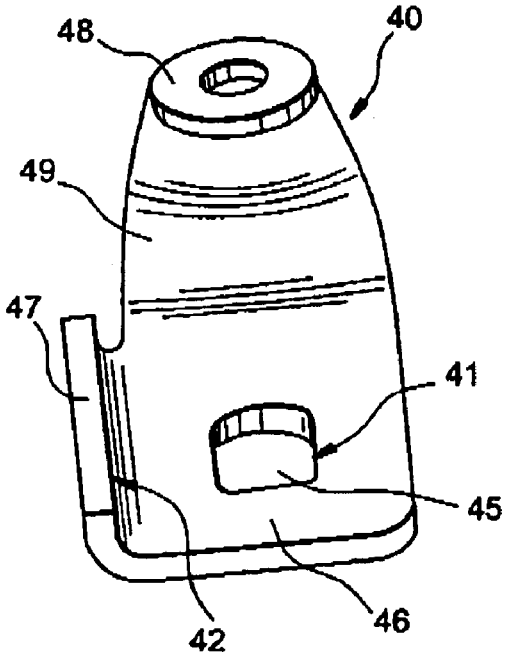
FIG. 4 shows the control lever of the device according to the invention.

FIG. 4 shows the control lever 40 only. The first end 46 can be seen, together with a prolongation by a central part 49 terminating by a bushing 48. This bushing is used for articulation of the control lever 40 on the control ring.

The side part 47 is curved with respect to the first end 46 in which the recess 45 is located. The second contact area 42 of the control lever 40 is located inside the curved side part 47. Finally, the first contact area 41 of the control lever 40 is located on one side of the recess 45 opposite the side part 47.

Figure 5:
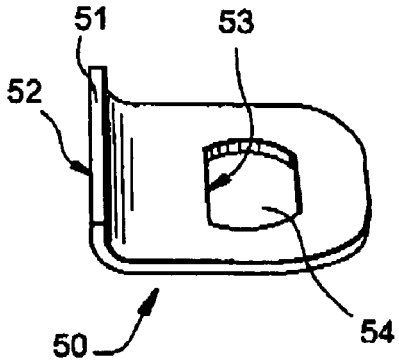
FIG. 5 shows an isometric view of the compensation plate used in the device according to the invention.

FIG. 5 shows the play compensation plate 50 alone. Correspondingly, the curved part 51 carrying the second contact area 52 located on the external surface of this curved part 51 can be seen.

The third contact area 53 is located on one side of the hole 54, on the same side as the curved part 51.

Figure 6:
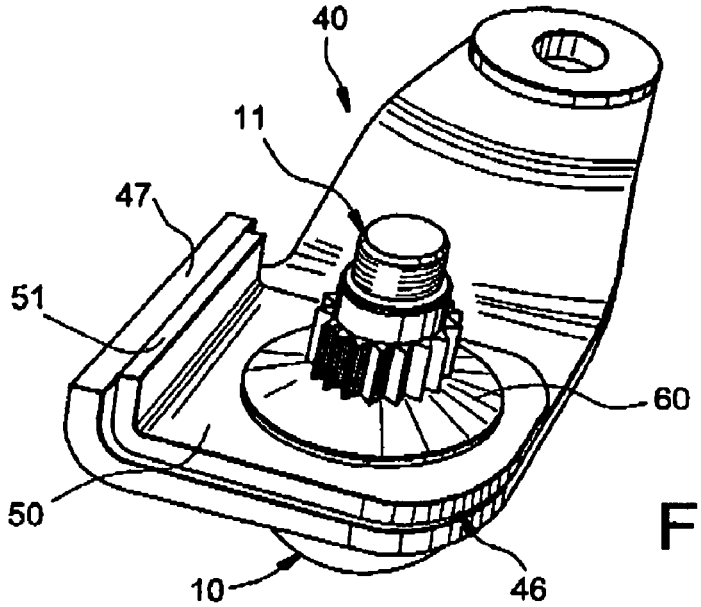
FIG. 6 shows an isometric view of the device according to the invention.

Finally, FIG. 6 shows an isometric view of the installed assembly. This figure shows the play compensation plate 50 installed on the first end 46 of the control lever 40 and bearing on the curved side part 47 through its curved end 51. The assembly is fixed using the nut 60 screwed onto the external pivot 11 of the blade 10.

It can be understood that it is thus easy for an operator to install the play compensation plate 50 on the first end 46 of the control lever 40, once the nut has been pulled clear from the external pivot 11 of the blade 10. Therefore screwing the nut 11 onto the external pivot 11 enables the play compensation plate 50 to be applied onto the entire first end 46 of the control lever 40, and particularly its curved part 51 to be applied on the curved side part 47 of the control lever.

It can be seen that no precise machining is necessary, apart from the contact surfaces in the first contact area.

The invention claimed is:

1. A control device for a blade of a turbomachine, comprising:

a lever with a first portion defining a lever hole such that said lever is configured to contact a drive part of the blade at a first contact area when said blade drive part is inserted in said lever hole, and further such that a play remains between said drive part and said lever when said drive part is inserted in said lever hole, wherein said lever has a second portion perpendicular to said first portion; and a plate that bears on said second portion of said lever at a second contact area and that defines a plate hole configured to receive said drive part.

2. A control device according to claim 1, wherein said lever is made of sheet metal.

3. A control device according to claim 1, wherein said drive part is inserted into said hole.

4. A control device according to claim 1, wherein said play is in a direction perpendicular to the first contact area.

5. A control device according to claim 1, wherein said plate hole is configured such that said plate contacts said drive part at a third contact area when said drive part is inserted into said plate hole.

6. A control device according to claim 5, wherein said plate hole is configured such that a play remains between said drive part and said plate when said drive part is inserted into said plate hole.

7. A control device according to claim 5, wherein said third contact area is opposite said first contact area relative to said drive part.

8. A control device according to claim 5, wherein a distance between said third contact area and said second contact area is equal to a distance between said first contact area and said second contact area minus a section of said drive part, wherein said section is located in said lever hole when said drive part is inserted in said lever hole.

9. A control device according to claim 5, wherein said third contact area is on a side of the plate hole which is closest to said second contact area.

10. A control device according to claim 9, wherein said first contact area is on a side of said lever hole which is farthest to said second contact area.

11. A control device according to claim 9, wherein said plate has a curved portion between said second contact area and said third contact area.

12. A control device for blades with variable setting angles in a turbomachine, comprising:

a control ring and several control levers each with a first end in which there is a drive hole and mounted on the drive part of an external pivot of a blade, and a second end connected to the control ring through an articulation, such that rotation of the control ring about the axis of the turbomachine causes a change in the blade setting angle, each control lever comprises sheet metal, the drive hole of the control lever having a first drive part designed to come into contact with the drive part of the drive pivot of the blade defining a first contact area between the control lever and the external pivot, with a play remaining between the drive part of the external pivot of the blade and the drive hole of the control lever in a direction perpendicular to the first contact area, the rotational drive of the first end of the control lever on the drive part of the blade being made through a play compensation plate that bears on a side part of the control lever approximately perpendicular to the first end of the control lever, through a second contact area between the control lever and the play compensation plate, approximately parallel to the first contact area to force the drive part of the blade onto the first end of the control lever through the first contact area.

13. The control device according to claim 12, wherein the play compensation plate is provided with a hole similar to the drive hole used in the control lever, and for which one side comes into contact with a wall of a recess in the blade located at the bottom of the external pivot, thus forming a third contact area between the play compensation plate and the external pivot.

14. A control device according to claim 12, wherein the first contact area between the control lever and the external pivot is plane in shape.

15. A control device for blades with variable setting angles in a turbomachine, comprising a control ring and several control levers each with a first end in which there is a drive hole and mounted on the drive part of an external pivot of a blade, and a second end connected to the control ring through an articulation, such that rotation of the control ring about the axis of the turbomachine causes a change in the blade setting angle, each control lever comprises sheet metal, the drive hole of the control lever having a first drive part designed to come into contact with the drive part of the drive pivot of the blade defining a first contact area between the control lever and the external pivot, with a play remaining between the drive part of the external pivot of the blade and the drive hole of the control lever in a direction perpendicular to the first contact area, the rotational drive of the first end of the control lever on the drive part of the blade being made through a play compensation plate that bears on a side part of the control lever approximately perpendicular to the first end of the control lever, through a second contact area between the control lever and the play compensation plate, approximately parallel to the first contact area to force the drive part of the blade onto the first end of the control lever through the first contact area, wherein the side part of the control lever on which the second contact area between the control lever and the play compensation plate is located, is perpendicular to the plane of the plate forming the control lever, the play compensation plate also being provided with a curved part that bears on the side part of the control lever through the second contact area between the control lever and the play compensation plate.

16. A control device according to claim 15, wherein the play compensation plate is provided with a hole similar to the drive hole used in the control lever, and for which one side comes into contact with a wall of a recess in the blade located at the bottom of the external pivot, thus forming a third contact area between the play compensation plate and the external pivot.

17. A control device according to claim 15, wherein the first contact area between the control lever and the external pivot is plane in shape.

* * * * *